US006434765B1

(12) United States Patent
Burns et al.

(10) Patent No.: US 6,434,765 B1
(45) Date of Patent: Aug. 20, 2002

(54) TOP MOUNT PLUMBING FIXTURE

(75) Inventors: Leonard J. Burns, Lorain; Nicholas A. Mascari, Newburgh Heights; Martin Zummersch, Westlake, all of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/746,623

(22) Filed: Feb. 20, 2001

(51) Int. Cl.[7] ..... E03C 1/04

(52) U.S. Cl. ..... 4/676; 4/378; 4/695; 137/359; 285/208

(58) Field of Search ..... 4/675, 676, 677, 4/678, 695; 137/359; 285/208, 209, 210

(56) References Cited

U.S. PATENT DOCUMENTS

| | | | | |
|---|---|---|---|---|
| 1,960,278 | A | 5/1934 | Niedecken | 4/677 |
| 3,010,474 | A | 11/1961 | Moen | 4/675 X |
| 3,785,396 | A | 1/1974 | Morris et al. | 4/676 X |
| 3,790,966 | A | 2/1974 | Keane | 4/676 |
| 4,005,883 | A | 2/1977 | Guest | 285/322 |
| 4,281,857 | A | 8/1981 | Randall | 285/34 |
| 4,356,574 | A | 11/1982 | Johnson | 4/676 |
| 4,553,277 | A | 11/1985 | Duncan | 4/643 |
| 4,654,900 | A | 4/1987 | McGhee | 4/670 |
| 4,671,316 | A | 6/1987 | Botnick | 4/675 X |
| 4,760,861 | A | 8/1988 | Botnick | 4/675 X |
| 4,762,143 | A | 8/1988 | Botnick | 4/675 X |
| 4,848,395 | A | 7/1989 | Krippendorf | 4/676 X |
| 4,852,192 | A | 8/1989 | Viegener | 4/678 |
| 4,967,784 | A | 11/1990 | Barhydt, Sr. et al. | 137/801 X |
| 4,998,555 | A | 3/1991 | Barhydt, Sr. et al. | 4/678 X |
| 5,010,922 | A | 4/1991 | Agresta | 137/359 |
| 5,127,427 | A | 7/1992 | Kajpust et al. | 4/678 X |
| 5,213,268 | A | 5/1993 | Gnauert et al. | 4/377 X |
| 5,232,008 | A | 8/1993 | Jeffress et al. | 137/359 X |
| 5,361,431 | A | 11/1994 | Freier et al. | 4/677 |
| 5,388,287 | A | 2/1995 | Tischler et al. | 4/678 |
| 5,465,749 | A | 11/1995 | Sauter et al. | 4/675 X |
| 5,515,882 | A | 5/1996 | Hennis | 4/676 X |
| 5,558,128 | A | 9/1996 | Pawelzik et al. | 4/377 X |
| 5,584,513 | A | 12/1996 | Sweeny et al. | 285/323 |
| 5,660,203 | A | 8/1997 | Gnauert et al. | 4/377 X |
| 5,822,811 | A | 10/1998 | Ko | 4/678 |
| 5,865,211 | A | 2/1999 | Thomas | 137/359 |
| 5,946,746 | A | 9/1999 | Bloom | 4/675 |
| 5,983,917 | A | 11/1999 | Thomas | 4/675 X |
| 6,014,985 | A | 1/2000 | Warshawsky | 4/677 X |
| 6,301,728 | B1 * | 10/2001 | Pilatiwicz et al. | 4/695 |

FOREIGN PATENT DOCUMENTS

| | | |
|---|---|---|
| EP | 0 213 656 | 3/1987 |

* cited by examiner

*Primary Examiner*—Robert M. Fetsuga
(74) *Attorney, Agent, or Firm*—Cook, Alex, McFarron, Manzo, Cummings & Mehler, Ltd.

(57) ABSTRACT

A plumbing fixture adapted to be installed from the top side of a sink deck through a sink deck opening includes a housing having a body portion which is adapted to extend through the sink deck opening and below the sink deck when mounted. The housing has a shoulder which is adapted to seat on the sink deck when mounted. There is a collar slidably movable on the body portion and of a size to pass through the sink deck opening. A threaded bore is in the collar and an unthreaded bore is in the housing shoulder, and a threaded member extends through these bores, with rotation of the threaded member from above the sink deck moving the collar axially along the housing body portion. Outwardly-biased yielding members are associated with the collar and extend outwardly therefrom such that when so extended the collar will not pass through the sink deck opening. The fixture is mounted to the sink deck by first compressing the outwardly extending yielding members to pass the body portion and collar through the sink deck opening from above the sink deck until the shoulder portion is seated on the sink deck and the yielding members have extended after passing is through the sink deck opening. The threaded member is then rotated until the collar has moved axially along the body portion and is in contact with the underside of the sink deck.

13 Claims, 2 Drawing Sheets

TOP MOUNT PLUMBING FIXTURE

THE FIELD OF THE INVENTION

The present invention relates to plumbing fixtures and particularly to such a fixture which may be mounted completely from above the sink deck. In the past, it has been conventional for the plumbing fixture to be seated upon the sink deck and then the installer, of necessity, must go underneath the sink deck to a small, cramped area to fasten the plumbing fixture onto the sink deck. The present invention removes the necessity for the installer to go beneath the sink deck for any purpose other than to attach the water connections or hoses between one or more of the plumbing fixtures.

The plumbing fixture of the present invention essentially provides a housing in which may be installed various types of plumbing devices such as a water control valve, the nipple for a spout, or the connection for a kitchen deck side spray. The plumbing fixture is essentially the same, regardless of the type of water control plumbing device which will be mounted in it.

The plumbing fixture includes a housing which has a body portion adapted to extend through a sink deck opening. There is a shoulder on the housing which seats on top of the sink deck around the sink deck opening. There is a collar slidable on the body portion and of a size to extend through the sink deck opening. The collar has a threaded bore and the shoulder has an unthreaded bore and there is a threaded member such as a bolt which extends through these bores, with rotation of the bolt, from above the sink deck, axially moving the collar along the body portion of the housing. There are outwardly-biased yielding elements which extend from the collar, and when compressed, allow the collar to pass through the sink deck opening, and when allowed to expand, prevent the collar from moving through the sink deck opening. Thus, these elements are compressed when the plumbing fixture is mounted to the sink deck opening, allowed to expand once they have passed through the sink deck opening, after which the bolt is turned to move the collar and the extended elements snugly up against the bottom of the sink deck to complete installation.

SUMMARY OF THE INVENTION

The present invention relates to a plumbing fixture which may be installed from above the sink deck.

A primary purpose of the invention is to provide a plumbing fixture which may be used to house various types of water control plumbing devices, and which may be installed, except for hose connections, from above the sink deck.

Another purpose of the invention is to provide a plumbing fixture which has outwardly-biased yielding members, which when extended, prevent the housing of the plumbing fixture from passing through a sink deck opening, but when compressed, will permit such passage.

Another purpose of the invention is to provide a simply constructed, reliable plumbing fixture which may be installed from above the sink, complete to the point of securing the fixture to the sink deck by turning a bolt from above the deck.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
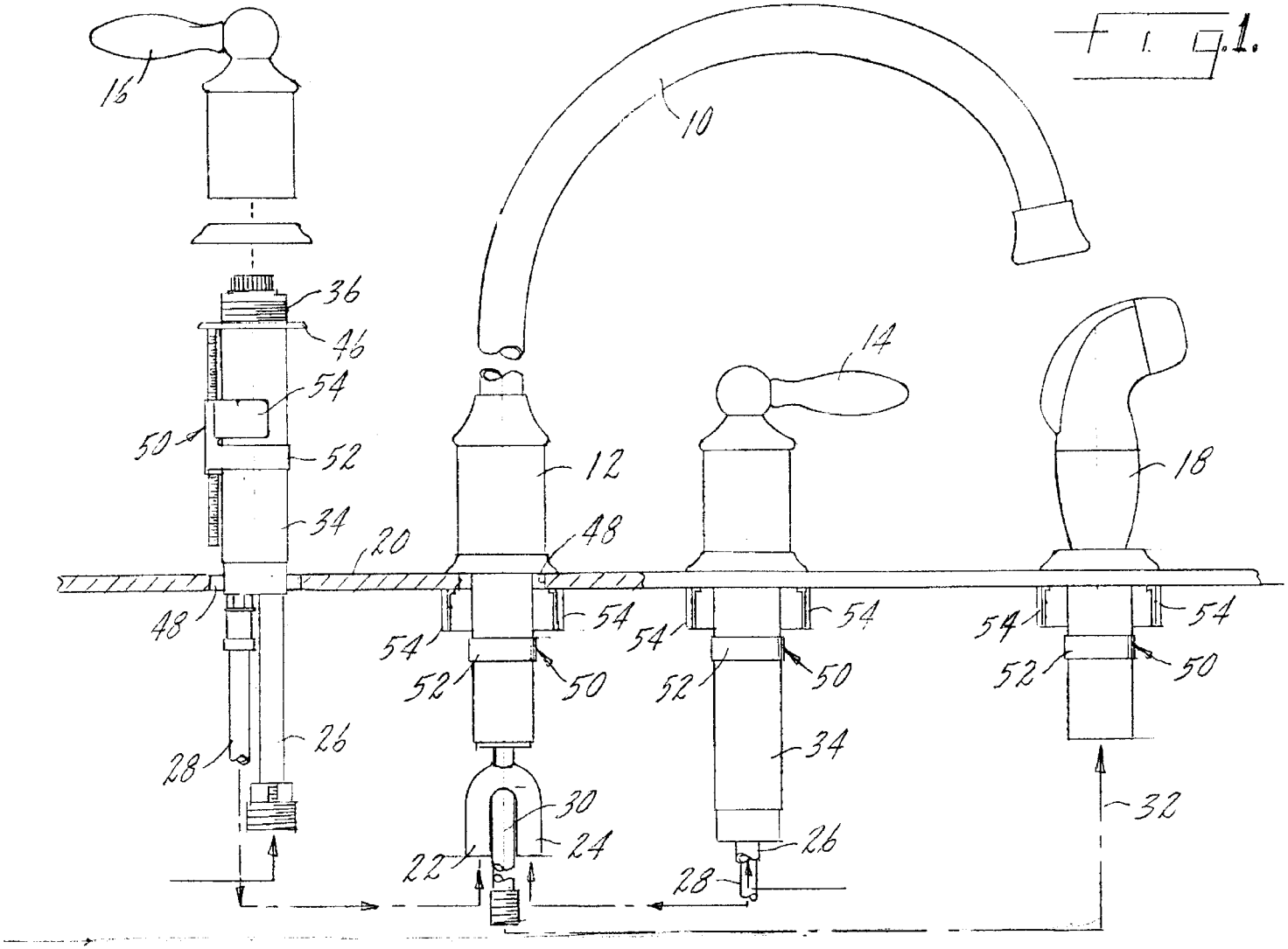
FIG. 1 is a front view, in part exploded, showing the plumbing fixture of the present invention as a part of a kitchen faucet installation having several water control plumbing devices.

FIG. 1 illustrates a kitchen faucet suite including a centrally disposed spout 10 extending outwardly from a spout nipple housing 12. On each side of the spout 10 there is a faucet control handle indicated at 14 on the right and at 16 on the left, with the left side faucet handle being shown in an exploded view. At the right of FIG. 1 there is a conventional kitchen a deck side spray 18. The plumbing fixture of the present invention may be used to mount any one of the above-described water control plumbing devices and these devices may be mounted from above the sink deck, with the exception of the hose connection between the various fixtures. For example, the spout nipple 12 shows, beneath the sink deck 20, a pair of input conduits 22 and 24 to connect the hot and cold water supplies from the valves 14 and 16. Similarly, there are hose connections beneath each of the valves 14 and 16 in the form of an input water connection 26 and an output hose 28 which, as shown by the arrows, connects to the input of the spout nipple 12. Similarly, there is an outlet 30 from the spout nipple which connects to the input of the side spray 18, as shown by the arrow 32. It is only these hose connections that must be made underneath the sink deck.

Figures 2, 3, 4, 5, 6, 7, 8:
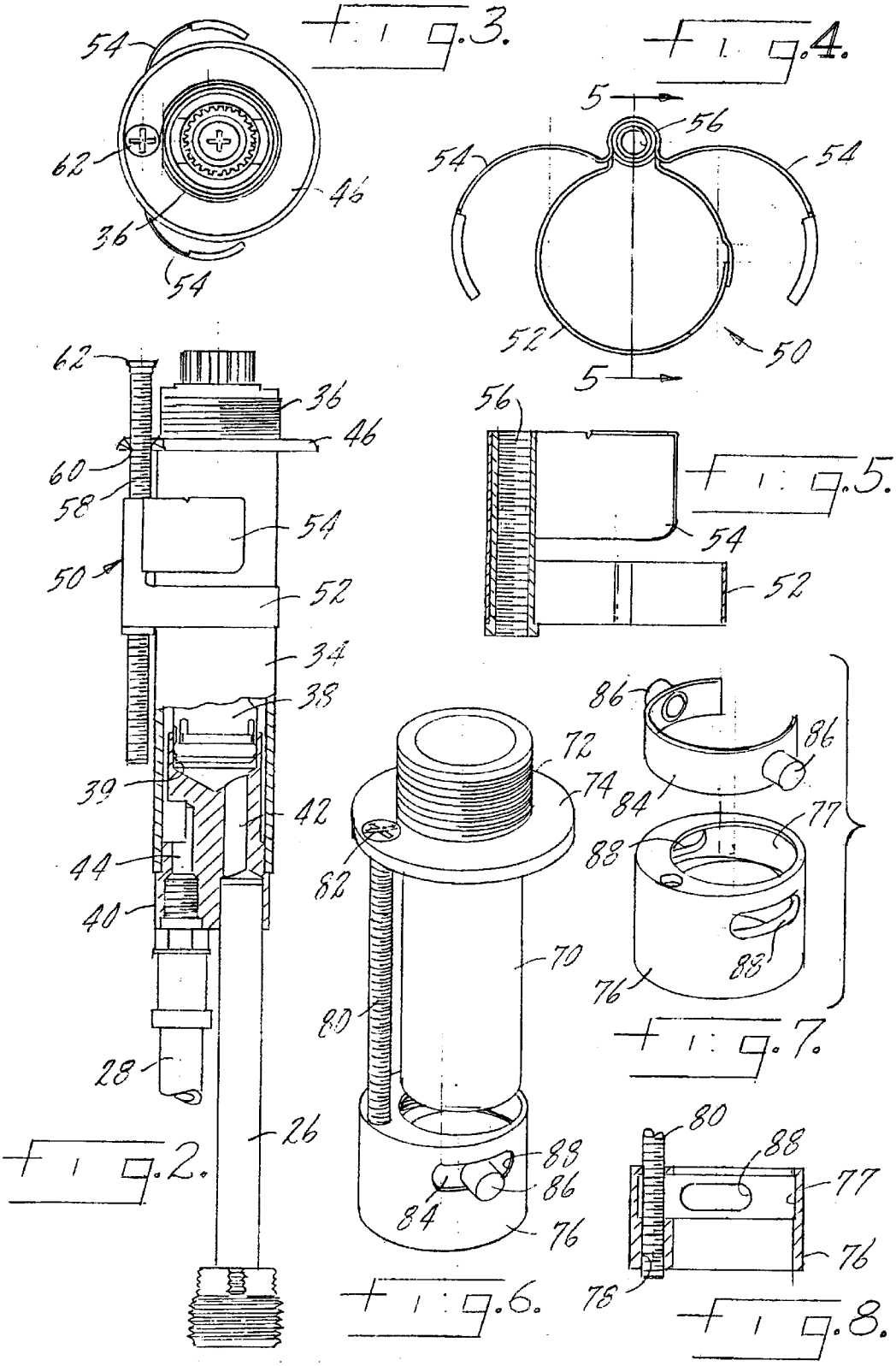
FIG. 2 is a partial axial section of the plumbing fixture of the present invention.
FIG. 3 is a top view of the plumbing fixture of FIG. 2.
FIG. 4 is a top view of the collar.
FIG. 5 is a section along plane 5—5 of FIG. 4.
FIG. 6 is a perspective view of a second embodiment of the invention.
FIG. 7 is an exploded perspective of the collar of the embodiment of FIG. 6.
FIG. 8 is a vertical section through the collar of FIG. 7.

The embodiment of the invention shown in FIGS. 2–5 provides one form of plumbing fixture which may be utilized with any of the water control devices illustrated in FIG. 1. The plumbing fixture has a housing, indicated generally at 34, which has an upper threaded portion 36 for use in mounting the handle 16 and it may have a hollow interior which will contain the valve cartridge 38 which may be one of several types manufactured by Moen Incorporated, the assignee of the present application. The cavity for the valve cartridge is shown in FIG. 2 at 39. The housing 34 has a valve body 40 which includes the inlet passage 42 and the outlet passage 44, with the control of fluid between these two passages being through the valve cartridge 38 placed within the cavity or chamber 39.

The housing 34 has a shoulder 46 which, as shown in FIG. 1, will be seated upon the top of the sink deck 20 after the housing is passed through the sink deck opening 48 when the plumbing fixture is mounted to the sink deck. The outer diameter of the housing 34 is less than the diameter of the sink deck opening 48 which permits the housing to be passed through the sink deck opening when the plumbing fixture is mounted thereon.

Slidably movable on the housing 34 is a collar 50 comprising a main, generally cylindrical, portion 52 having an outer diameter of a size to pass through the sink deck opening 48 and a pair of flexible, yielding, arcuate arms 54 which may be formed by a single spring20 like member, as shown in the top view of the collar in FIG. 4. Both the collar portion 52 and the arms 54 define a threaded bore 56 within which is mounted a threaded bolt 58. The bolt 58 extends through an unthreaded bore 60 in the shoulder 46 and may have a tool receiving head 62 at its upper end. The outer diameter of the collar, which includes that portion of the collar containing the threaded bore 56, is of a size to pass through the sink deck opening 48 when the flexible arms 52 are compressed toward and closely encircle the cylindrical portion 52 of the collar 50.

To mount the plumbing fixture illustrated in FIGS. 2–5, the first step by the installer is to compress the arms 54 so that they closely encircle the cylindrical portion 52 of the collar. The housing 34 and the collar may then be passed through the sink deck opening 48 until the shoulder 46 is seated upon the top of the sink deck 20. The bolt 58 is then turned by the use of a screwdriver or other tool in the tool receiving opening 62, with the end result that the collar, with the now expanded arms 54, will be pulled up tight against the bottom of the sink deck, as shown in FIG. 1, for the spout nipple 12, the valve control handles 14 and 16, and the side spray 18.

FIGS. 6, 7 and 8 show an alternative embodiment of the invention which would be mounted to the sink deck in the same manner as the FIGS. 2–5 embodiment. There is a housing 70 which has a threaded portion 72 and a shoulder 74, as in the earlier-described embodiment. A collar is indicated at 76 and is cylindrical in its exterior dimension and has a threaded bore 78 which will receive a threaded bolt 80, with the bolt extending through an unthreaded opening in the shoulder 74 and having a tool receiving opening 82 at the upper end thereof.

Positioned inside of the collar 76 in a recessed groove 77 is a flexible arcuate spring element 84 which has a pair of diametrically opposed, outwardly extending button-like projections 86. These projections will extend through arcuate slots 88 in the collar 76 when the spring element 84 is placed inside of the collar. The element 84 and the button-like projections 86 function in the same manner as the flexible arms 54. To pass the housing 70 through the sink deck opening 48, the button-like projections must first be compressed. Once past the opening, the spring element 84 will cause the button-like projections to extend completely through the diametrically opposed slots 88, which would then prevent the housing from being moved upwardly through the sink deck. Again, the bolt 80 will be turned, which will draw the collar 76 snugly up against the bottom of the sink deck to firmly attach the plumbing fixture to the deck.

Of importance in the invention is the provision of a system for installing the plumbing fixture from above the sink deck and then through the use of a hand tool, permitting the installer to draw up the fastening collar snugly against the bottom of the sink deck without having to go into the cramped area beneath the deck. The collar, in both forms of the invention, includes a pair of outwardly-extending flexible elements, arms in the FIGS. 2–5 embodiment, and spring-like buttons in the FIGS. 6–8 embodiment. In both instances, the flexible elements are compressed against the body of the plumbing fixture to allow the fixture to be passed through the sink deck opening. The flexible elements will then automatically spring outwardly so that when the collar is snugged up against the bottom of the deck, the fixture is fully attached.

Whereas the preferred form of the invention has been shown and described herein, it should be realized that there may be many modifications, substitutions and alterations thereto.

The embodiments of the invention in which an exclusive property or privilege is claimed are defined as follows:

1. A plumbing fixture adapted to be installed from the top side of a sink deck through a sink deck opening, said fixture including a housing having a body portion which is adapted to extend through the sink deck opening and extend below the sink deck when mounted, and a shoulder portion on said housing which is adapted to seat on the sink deck when mounted, a collar slidably movable on said body portion and of a size to pass through the sink deck opening, a threaded bore in said collar, an unthreaded bore in said housing shoulder portion, a threaded member extending through said unthreaded and threaded bores, with rotation of said threaded member from above the sink deck moving said collar axially along said housing body portion, arcuate outwardly-biased yielding means associated with said collar and having a portion thereof extending outwardly therefrom, such that when so extended the collar will not pass through the sink deck opening, whereby the plumbing fixture is adapted to be mounted to the sink deck by first compressing the yielding means to pass the body portion and collar through the sink deck opening from above the sink deck until the shoulder portion is seated on the sink deck and the yielding means has extended after passing through the sink deck opening, the threaded member is then rotated until the collar has moved axially along the body portion and is in contact with an underside of the sink deck.

2. The plumbing fixture of claim 1 wherein said yielding means includes a pair of elements, generally on opposite sides of said collar, and compressible toward said collar.

3. The plumbing fixture of claim 2 wherein each of said elements includes an outwardly extending arm.

4. The plumbing fixture of claim 3 wherein said outwardly extending arms are integral.

5. The plumbing fixture of claim 3 wherein each of said outwardly extending arms is arcuate in shape.

6. The plumbing fixture of claim 1 wherein said yielding means includes an outwardly extending compressible arcuate arm, attached to said collar, and when fully extended prevents said collar from moving through the sink deck opening.

7. The plumbing fixture of claim 2 wherein each of said elements includes a button-shaped projection.

8. The plumbing fixture of claim 7 wherein said button-shaped projections are a part of an arcuate element which is located inside of the collar.

9. The plumbing fixture of claim 8 wherein said button-shaped projections extend through slots in opposite sides of said collar.

10. The plumbing fixture of claim 1 wherein said yielding means includes at least one outwardly extending button-shaped member, extending from within said collar, outwardly through a slot in said collar, with said button-shaped member, when so extended, preventing the passage of said collar through the sink deck opening.

11. The plumbing fixture of claim 1 wherein said plumbing fixture body member is formed and adapted to receive a water control valve.

12. The plumbing fixture of claim 1 wherein said body member is formed and adapted to mount a faucet spout nipple.

13. The plumbing fixture of claim 1 wherein said body member is formed and adapted to mount a faucet side spray.

* * * * *